US007892013B1

(12) United States Patent
Piekos et al.

(10) Patent No.: US 7,892,013 B1
(45) Date of Patent: Feb. 22, 2011

(54) RECEPTACLE CONNECTOR WITH A STUFFER BAR WITHIN RETENTION SECTIONS OF THE CONTACTS

(75) Inventors: William Walter Piekos, Camp Hill, PA (US); Brian Keith McMaster, Jr., Mechanicsburg, PA (US); Lester Robert Zimmerman, Jr., Harrisburg, PA (US); Edward J. Bright, Middletown, PA (US); Michael F. Cina, Elizabethtown, PA (US); Harold William Kerlin, Port Royal, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/767,365

(22) Filed: Apr. 26, 2010

(51) Int. Cl.
*H01R 13/627* (2006.01)

(52) U.S. Cl. ..... 439/352

(58) Field of Classification Search ..... 439/352, 439/347, 308, 660, 368
See application file for complete search history.

(56) References Cited

U.S. PATENT DOCUMENTS 5,474,468 A * 12/1995 Chishima et al. ..... 439/495
5,492,483 A * 2/1996 Cheng et al. ..... 439/339
6,655,978 B2 * 12/2003 Lutsch et al. ..... 439/352
6,926,565 B2 8/2005 Fogg
7,025,617 B2 4/2006 Regnier et al.
7,048,567 B2 5/2006 Regnier et al.
7,070,446 B2 7/2006 Henry et al.
7,249,966 B2 7/2007 Long
7,261,591 B2 8/2007 Korsunsky et al.
7,410,382 B2 * 8/2008 Wu ..... 439/358
7,572,150 B2 * 8/2009 Matsuoka ..... 439/626
7,744,382 B2 * 6/2010 Zheng et al. ..... 439/79
7,794,241 B2 * 9/2010 Bright et al. ..... 439/79
2009/0124128 A1 5/2009 Regnier

* cited by examiner

*Primary Examiner*—Chandrika Prasad

(57) ABSTRACT

A transceiver assembly includes a receptacle guide frame configured to be mounted to a host circuit board, where the receptacle guide frame has a front being open to an interior space, and where the receptacle guide frame is configured to receive a pluggable module through the front. A receptacle connector is received within the interior space of the receptacle guide frame at a rear of the receptacle guide frame. The receptacle connector includes contacts having contact tails configured to be mounted to a circuit board. The contacts have retention sections positioned at a predetermined location relative to the contact tails, and the contacts have mating sections configured for mating with a mating connector. A housing holds the contacts and has a front and a rear with a cavity at the front being configured to receive the mating connector. The housing has a shelf at the rear. A stuffer bar is separately provided from the housing and securely coupled to the rear of the housing. The stuffer bar is received within the retention sections of the contacts and engages the contacts to hold the contacts against the shelf such that the contact tails are aligned with one another.

20 Claims, 6 Drawing Sheets

RECEPTACLE CONNECTOR WITH A STUFFER BAR WITHIN RETENTION SECTIONS OF THE CONTACTS

BACKGROUND OF THE INVENTION

The subject matter herein relates generally to a transceiver assembly, and more particularly, to a receptacle connector for use in a transceiver assembly.

Various types of fiber optic and copper based transceiver assemblies that permit communication between electronic host equipment and external devices are known. These transceiver assemblies typically include a module assembly that can be pluggably connected to a receptacle in the host equipment to provide flexibility in system configuration. The module assemblies are constructed according to various standards for size and compatibility, one standard being the Small Form-factor Pluggable (SFP) module standard. Conventional SFP modules and receptacle assemblies perform satisfactorily carrying data signals at rates up to 2.5 gigabits per second (Gbps). Another pluggable module standard, the XFP standard, calls for the transceiver module to carry data signals at rates up to 10 Gbps.

The pluggable modules are plugged into a transceiver assembly that is mounted on a circuit board within the host equipment. The transceiver assembly includes an elongated guide frame, or cage, having a front that is open to an interior space, and a receptacle connector disposed at a rear of the cage within the interior space. Both the receptacle connector and the guide frame are electrically and mechanically connected to the circuit board, and when the pluggable module is plugged into the transceiver assembly, the pluggable module is electrically and mechanically connected to the circuit board as well.

Problems arise with mounting the receptacle connectors to the circuit board. For example, it is desirable to have solder tails of the electrical connectors coplanar to ensure good electrical connections to the circuit board. However, because of tolerance build-ups and other manufacturing problems such as contact float, where the contacts tend to raise upward in the housing, the solder tails may not be completely coplanar, leading to inadequate connections between the electrical connector and the circuit board. Another problem with known receptacle connectors arises during mating with the pluggable module. Such mating may force the contacts rearward and out of position within the housing.

It would be desirable to provide a receptacle connector for a transceiver assembly that exhibits good mechanical stability during assembly. It would be desirable to provide a receptacle connector for a transceiver assembly that exhibits good mechanical stability during mating with a pluggable module.

BRIEF DESCRIPTION OF THE INVENTION

In one embodiment, a receptacle connector is provided that includes contacts having contact tails configured to be mounted to a circuit board. The contacts have retention sections positioned at a predetermined location relative to the contact tails, and the contacts have mating sections configured for mating with a mating connector. A housing holds the contacts and has a front and a rear with a cavity at the front being configured to receive the mating connector. The housing has a shelf at the rear. A stuffer bar is separately provided from the housing and securely coupled to the rear of the housing. The stuffer bar is received within the retention sections of the contacts and engages the contacts to hold the contacts against the shelf such that the contact tails are aligned with one another.

In another embodiment, a receptacle connector for mating with a pluggable module of a transceiver assembly is provided. The receptacle connector includes contacts having posts and mating sections extending from the posts for mating with the pluggable module. The posts have a front and a rear with contact tails at an end thereof opposite the mating sections and the posts also have retention sections. A housing holds the contacts and has a front and a rear with a cavity at the front being configured to receive the pluggable module. A stiffer bar is separately provided from the housing and is securely coupled to the housing proximate to the rear of the housing. The stuffer bar has a base and a shoulder extending forward from the base that is received in the retention sections. The base engages the rear of the posts to hold the contacts in the housing.

In a further embodiment, a transceiver assembly is provided that includes a receptacle guide frame configured to be mounted to a host circuit board, where the receptacle guide frame has a front being open to an interior space, and where the receptacle guide frame is configured to receive a pluggable module through the front. A receptacle connector is received within the interior space of the receptacle guide frame at a rear of the receptacle guide frame. The receptacle connector includes contacts having contact tails configured to be mounted to a circuit board. The contacts have retention sections positioned at a predetermined location relative to the contact tails, and the contacts have mating sections configured for mating with a mating connector. A housing holds the contacts and has a front and a rear with a cavity at the front being configured to receive the mating connector. The housing has a shelf at the rear. A stuffer bar is separately provided from the housing and securely coupled to the rear of the housing. The stuffer bar is received within the retention sections of the contacts and engages the contacts to hold the contacts against the shelf such that the contact tails are aligned with one another.

DETAILED DESCRIPTION OF THE INVENTION

Figure 1:
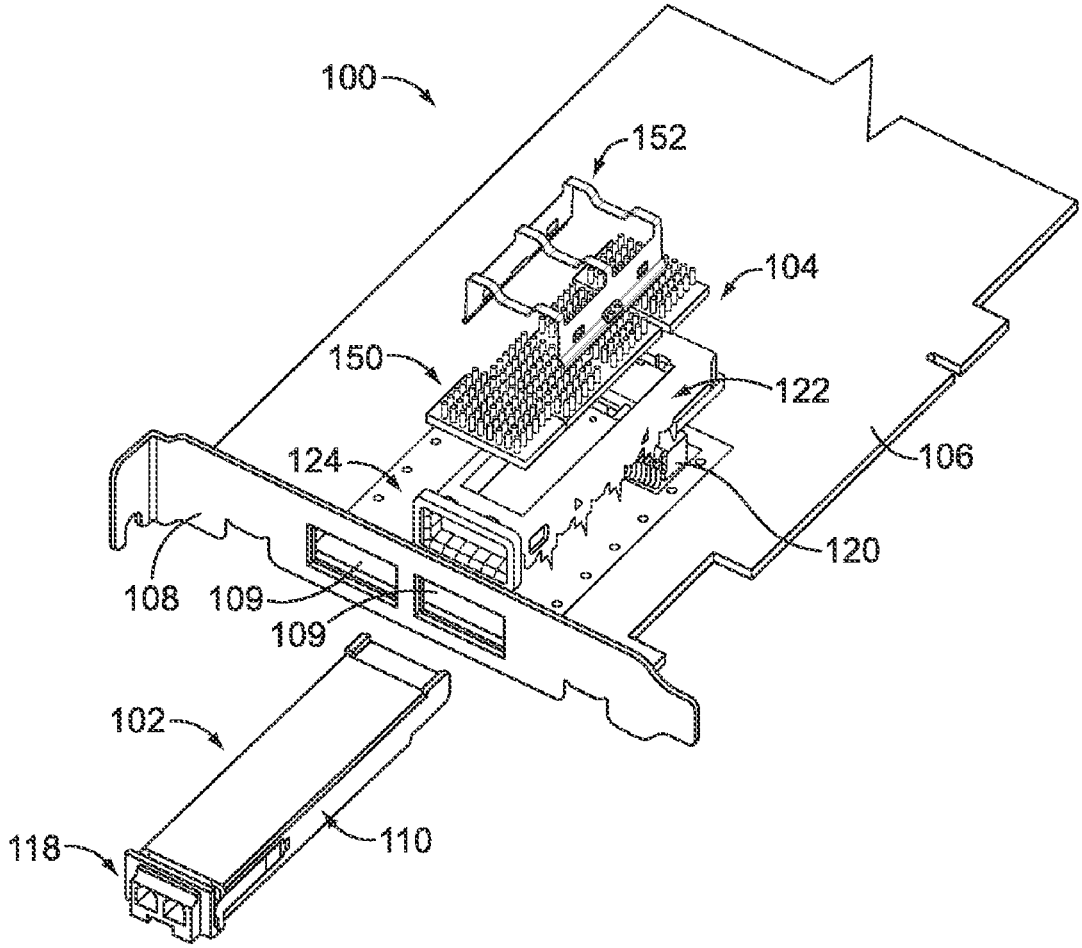
FIG. 1 is an exploded perspective view of a transceiver assembly formed in accordance with an exemplary embodiment.

FIG. 1 illustrates a transceiver assembly 100 adapted to address, among other things, conveying data signals at high rates, such as data transmission rates of 10 gigabits per second (Gbps) required of the XFP standard. It is appreciated, however, that the benefits and advantages of the subject matter described herein may accrue equally to other data transmission rates and across a variety of systems and standards.

As shown in FIG. 1, the assembly 100 generally includes a pluggable module 102 configured for pluggable insertion into a receptacle assembly 104 that is mounted to a host circuit board 106, which, in turn, is mounted in a host system such as a router or computer (not shown). The host system typically includes a conductive chassis having a bezel 108 including openings 109 therethrough in substantial alignment with a respective receptacle assembly 104. The pluggable module 102 is inserted into the receptacle assembly 104 through the bezel opening 109, and the receptacle assembly 104 is electrically connected to the bezel 108.

In the illustrated embodiment, the pluggable module 102 includes a housing 110 that forms a protective shell for a circuit board 112 (shown in FIG. 3) that is disposed within the housing 110. The circuit board 112 carries electronic circuitry and devices that perform transceiver functions in a known manner. An edge 114 (shown in FIG. 3) of the circuit board 112 is exposed through a rear of the housing 110, and the edge 114 is pluggable into the receptacle assembly 104 as described below. Alternatively, a connector may be mounted to the circuit board and exposed through the rear of the housing 110 for plugging into the receptacle assembly 104. The pluggable module 102 is adapted for installation into the receptacle assembly 104 such that a front end 118 of the pluggable module 102 is extended therefrom.

The pluggable module 102 is configured to be inserted into the receptacle assembly 104. In general, the pluggable module 102 and receptacle assembly 104 may be used in any application requiring an interface between a host system and electrical or optical signals. The pluggable module 102 interfaces to the host system through the receptacle assembly 104 via a receptacle connector 120 which is located within a receptacle guide frame 122, also referred to as a cage 122. The pluggable module 102 interfaces to an optical fiber or electrical cable (not shown in FIG. 1) through a connector interface at the front end 118 of the pluggable module 102.

The pluggable module 102 and the receptacle assembly 104 reduce EMI emission through one or more of several EMI reduction features, including the receptacle guide frame 122 and one or more gasket assemblies 124.

The receptacle connector 120 is mounted on the host circuit board 106 of the host equipment separate from the receptacle guide frame 122 and gasket assemblies 124. The receptacle connector 120 includes a slot that receives the edge 114 of the circuit board 112 or a connector mounted to the circuit board 112 that is carried by the pluggable module 102 when the pluggable module 102 is fully installed in the receptacle guide frame 122, thereby electrically connecting the pluggable module 102 to the host equipment.

The receptacle guide frame 122 accommodates an optional heat sink 150. The heat sink 150 is positioned to make physical contact with the pluggable module 102 when the pluggable module 102 is installed into the receptacle assembly 104. A clip 152 is mounted over the heat sink 150 and is secured to the receptacle guide frame 122. The clip 152 ensures that the heat sink 150 is loaded against the pluggable module 102 to facilitate thermal transfer from the pluggable module 102 to the heat sink 150.

Figure 2:
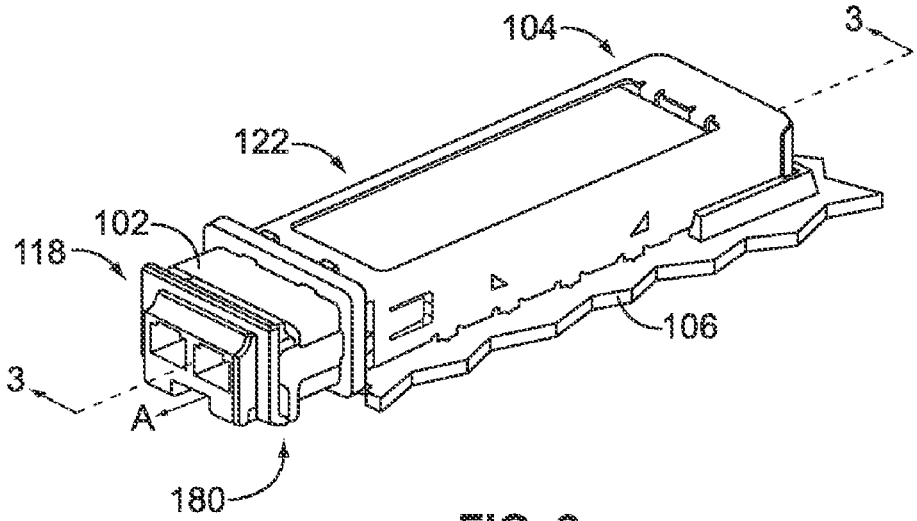
FIG. 2 is an assembled perspective view of a portion of the assembly shown in FIG. 1, showing a pluggable module mated with a receptacle assembly.

FIG. 2 is a perspective view of the receptacle assembly 104 mounted to the host circuit board 106 and receiving the pluggable module 102, with the heat sink 150 and the clip 152 (both shown in FIG. 1) removed for clarity. Also, the bezel 108 is not shown in FIG. 2.

The pluggable module 102 is illustrated in a latched position wherein removal from the receptacle guide frame 122 is prevented. An axial pull on the front end 118 of the pluggable module 102 in the direction of arrow A, when latched, is ineffective to remove the pluggable module 102. An ejector mechanism 180 is provided on the front end 118 of the pluggable module 102 for unlatching the pluggable module 102 for removal from the receptacle guide frame 122.

Figure 3:
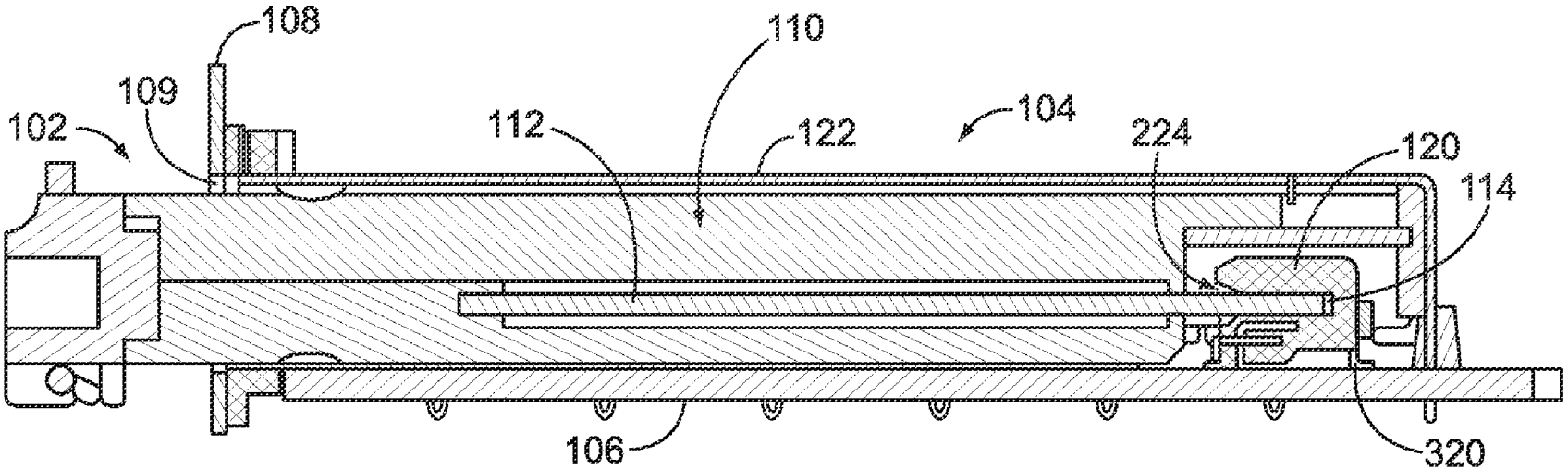
FIG. 3 is a cross sectional view of a portion of the assembly shown in FIG. 1, showing the pluggable module mated with the receptacle assembly.

FIG. 3 is a cross sectional view of the pluggable module 102 coupled to the receptacle assembly 104 with the pluggable module 102 in the latched position. The pluggable module 102 includes the circuit board 112 therein. The edge 114 of the circuit board 112 is received in a connector slot 224 of the receptacle connector 120 which is mechanically and electrically mounted to the host circuit board 106. The receptacle connector 120 includes electrical contacts 320 that contact conductive terminations on the end of the circuit board 112 to establish electrical connection to conductive paths on the host circuit board 106. When the pluggable module 102 is inserted into the receptacle guide frame 122, the edge 114 of the circuit board 112 is inserted into the connector slot 224, and when the pluggable module 102 is fully inserted into the receptacle guide frame 122, the pluggable module 102 is locked in the latched position with the circuit board 112 fully engaged to the receptacle connector 120.

Figure 4:
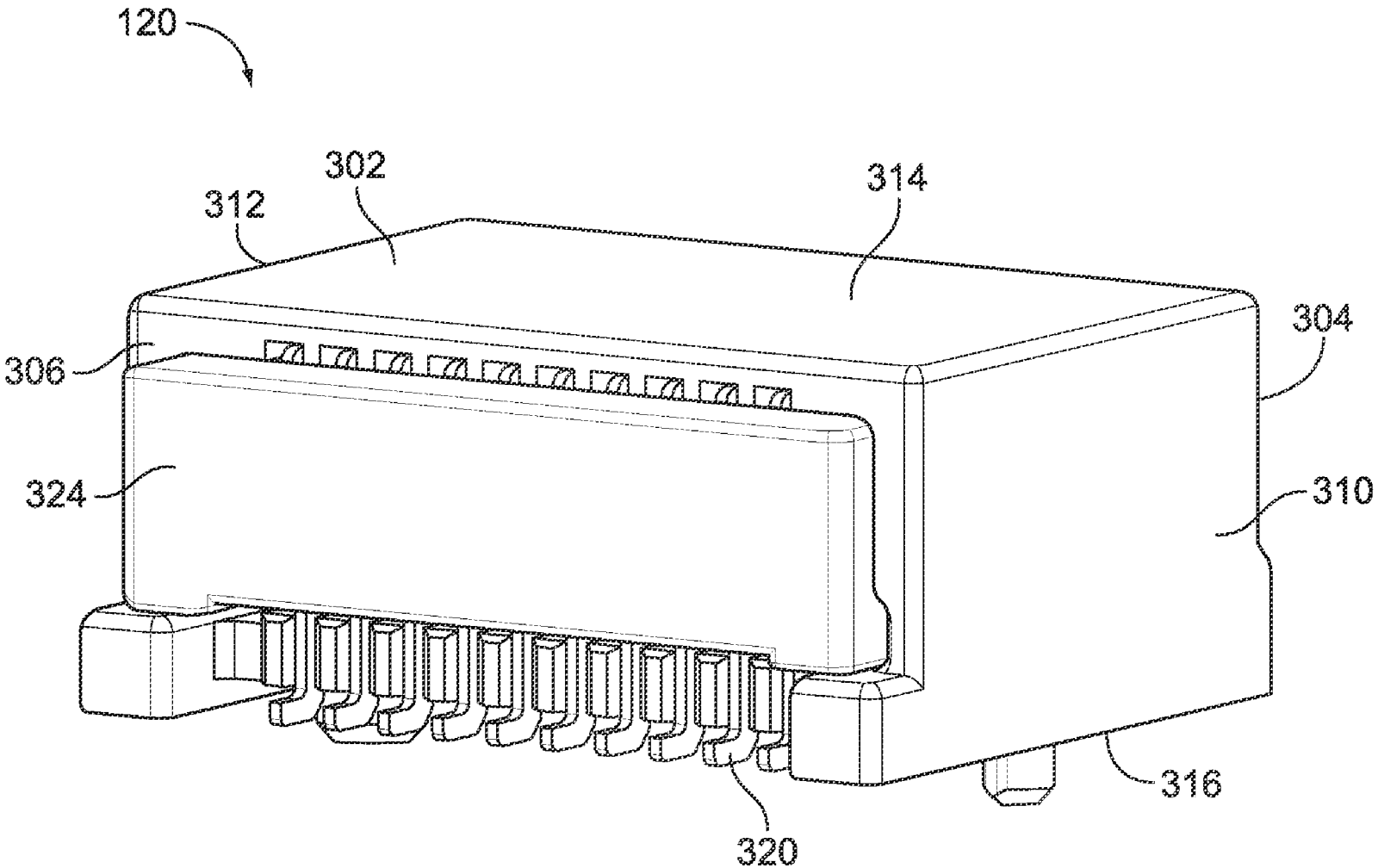
FIG. 4 is a rear perspective view of a receptacle connector for a receptacle assembly and formed in accordance with an exemplary embodiment.

FIG. 4 is a rear perspective view of the receptacle connector 120 for the receptacle assembly 104 (shown in FIG. 1). The receptacle connector 120 includes a housing 302 having a front 304 and a rear 306. The receptacle connector 120 is configured to mate with a mating connector, such as the pluggable module 102 (shown in FIG. 1), at the front 304. For example, the circuit board 112 (shown in FIG. 3) may be received in the connector slot 224 (shown in FIG. 3) open at the front 304. The housing 302 includes opposed sides 310, 312 and a top 314 generally opposite a bottom 316. The bottom 316 is configured to be mounted to a circuit board, such as the host circuit board 106.

The receptacle connector 120 includes a plurality of contacts 320 loaded into the cavity 322 (shown in FIG. 9) of the housing 302. The contacts 320 are loaded through the rear 306 of the housing 302. The receptacle connector 120 also includes a stuffer bar 324 separately provided from the housing 302 and securely coupled to the housing 302, such as at the rear 306. The stuffer bar 324 engages the contacts 320 to hold the contacts 320 within the housing 302. For example, the stuffer bar 324 resists rearward movement of the contacts 320 out of the cavity 322 and/or the stuffer bar 324 resists upward movement of the contacts 320 away from the host circuit board 106.

Figure 5:
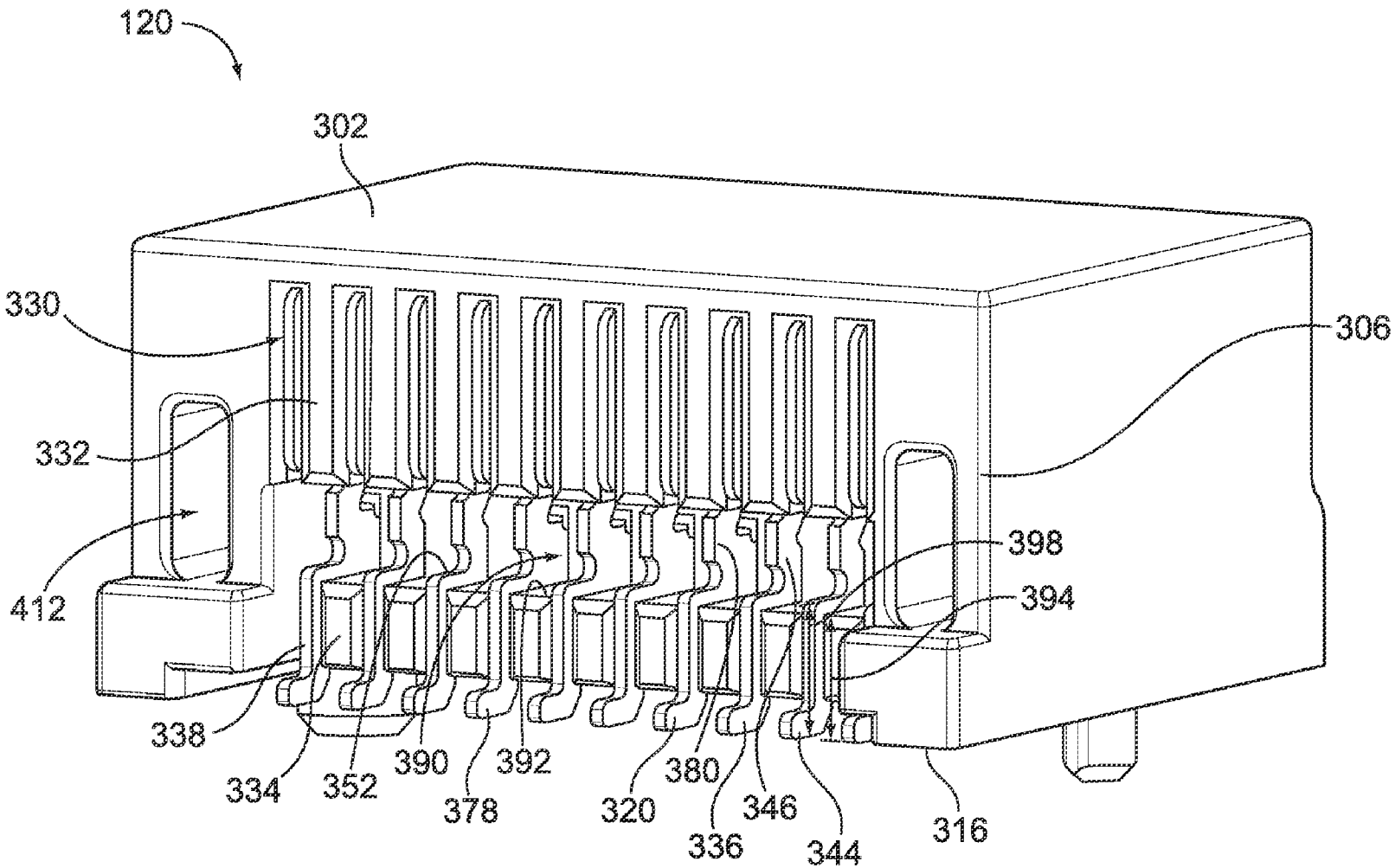
FIG. 5 is a rear perspective view of a portion of the receptacle connector shown in FIG. 4.

FIG. 5 is a rear perspective view of a portion of the receptacle connector 120 with the stuffer bar 324 (shown in FIG. 4) removed for clarity. In an exemplary embodiment, the housing 302 includes a plurality of grooves 330 formed therein at the rear 306 of the housing 302. The grooves 330 receive corresponding contacts 320 therein. The grooves 330 help hold the contacts 320 in position relative to one another (e.g. side-to-side position).

The grooves 330 are generally formed by wall portions 332, 334 positioned between the contacts 320. The wall portions 332, 334 of the housing 302 are formed from a dielectric material. Electrical characteristics of the contacts 320 are controlled by selecting a particular type of dielectric material for the wall portions 332, 334 and/or by controlling the height of the wall portions 332, 334 between the contacts 320. Between the wall portions 332, 334, the contacts 320 are separated from one another by air, which has a different dielectric constant than the wall portions 332, 334, and thus affects the electrical characteristics of the contacts 320 differently then the wall portions 332, 334.

In the illustrated embodiment, the contacts 320 include both signal contacts 336 and ground contacts 338. Other types of contacts, such as power contacts, may be used in alternative embodiments or alternative applications. Optionally, the signal contacts 336 may be arranged in pairs with each signal contact 336 within a pair carrying a differential signal, thus defining differential pairs. The ground contacts 338 are provided between the pairs of signal contacts 336.

Figure 6:
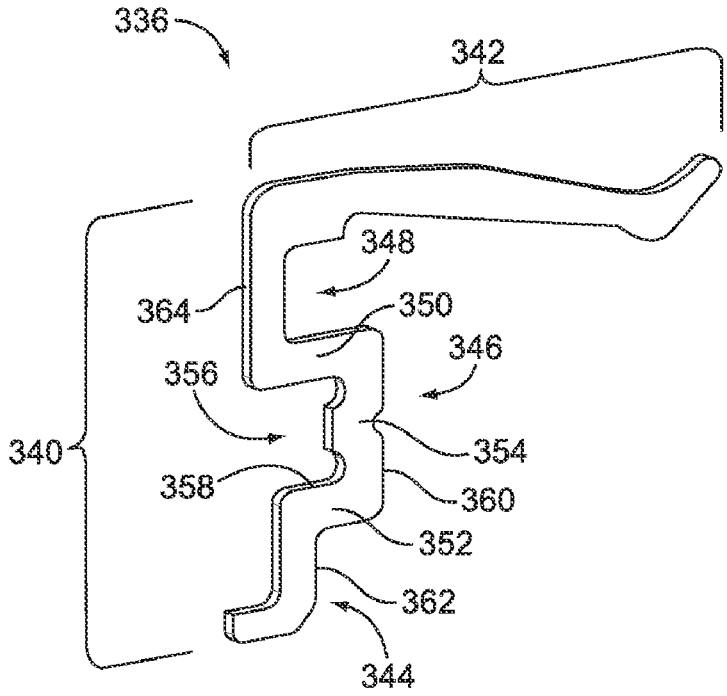
FIG. 6 is a perspective view of a signal contact for the receptacle connector shown in FIG. 4.

FIG. 6 is a perspective view of one of the signal contacts 336. Each signal contact 336 includes a post 340 and a mating section 342 that extends generally perpendicular from the post 340. For example, the post 340 is oriented generally vertical (e.g. along the rear 306 of the housing 302 (shown in FIG. 5)) and the mating section 342 is oriented generally horizontal (e.g. parallel to the host circuit board 106 (shown in FIG. 1)). In an exemplary embodiment, each contact 320 includes a contact tail 344 configured to be mounted to the host circuit board 106. Optionally, the contact tail 344 may be curved or angled such that a mounting portion of the contact tail 344 is generally perpendicular with respect to the post 340 and is oriented for surface mounting to the host circuit board 106, such as by soldering. Alternatively, the contact tail 344 may be a pin, such as a compliant pin, for through-hole mounting to the host circuit board 106.

In an exemplary embodiment, the post 340 includes a retention section 346 with an open side and an upper post section 348 between the retention section 346 and the mating section 342. The retention section 346 is configured to receive the stuffer bar 324 (shown in FIG. 4), as will be described in further detail below.

The retention section 346 is defined by an upper leg 350, a lower leg 352 and an inner leg 354 generally opposite the open side. The inner leg 354 extends between the upper and lower legs 350, 352. The inner leg 354 defines a forward-most portion of the post 340. The legs 350-354 define a channel 356 that receives the stuffer bar 324. Any or all of the legs 350-354 may engage the stuffer bar 324 when loaded into the channel 356. In an exemplary embodiment, the upper and lower legs 350, 352 may be parallel to one another and perpendicular to the inner leg 354. As such, the retention section 346 is generally U-shaped with the open side at a rear of the retention section 346. In an alternative embodiment, the upper and lower legs 350, 352 may be non-parallel to one another, and may extend either toward one another or away from one another. The retention section 346 includes an inner surface 358 and an outer surface 360. The inner surface 358 defines the channel 356. The stuffer bar 324 engages the inner surface 358. The outer surface 360 faces, and may engage the housing 302.

The post 340 includes a front 362 and a rear 364 opposite the front 362. The mating section 342 extends forward from the front 362. The open side of the retention section 346 is provided along the rear 364 of the post 340. The contact tail 344 extends rearward from the rear 364.

Figure 7:
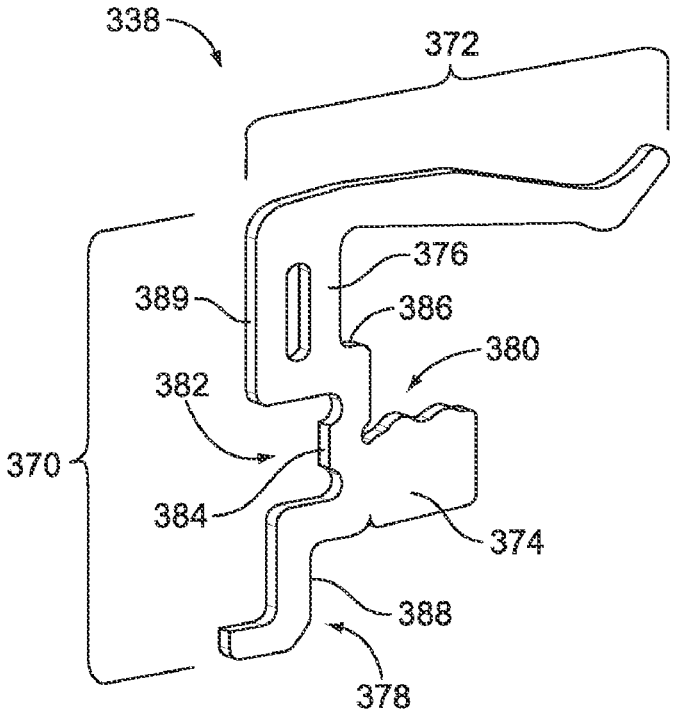
FIG. 7 is a perspective view of a ground contact for the receptacle connector shown in FIG. 4.

FIG. 7 is a perspective view of one of the ground contacts 338. Each ground contact 338 includes a post 370 and a mating section 372 that extends generally perpendicular from the post 370. The ground contact 338 may be similar to the signal contact 336, however the ground contact 338 includes a retention barb 374 and an inner post 376. The retention barb 374 is received in the housing 302 (shown in FIG. 5) and holds the ground contact 338 in the housing 302, such as by a friction fit. The ground contact 338 may reduce crosstalk between differential pairs providing a greater footprint than the signal contact 336. Similarly, the inner post 376 may reduce crosstalk between differential pairs providing a greater footprint than the signal contact 336.

In an exemplary embodiment, both the signal and ground contacts 336, 338 may be stamped from a common stamp. When the retention barb 374 and the inner post 376 are removed, such as during a second stamping process, the contact has the form of a signal contact 336 rather than a ground contact 338. When the retention barb 374 and the inner post 376 remain, the contact has the form of a ground contact 338. Alternatively, the stamps may be different for the signal and ground contacts 336, 338 during an initial stamping process to define the contact as either a signal contact 336 or a ground contact 338.

The post 370 includes a contact tail 378 similar to the contact tail 344 (shown in FIG. 6). The post 370 also includes a retention section 380 configured to receive the stuffer bar 324 (shown in FIG. 4). The retention section 380 may be U-shaped and may define a channel 382 that receives the stuffer bar 324. The retention section 380 includes an inner surface 384 and an outer surface 386. The inner surface 384 defines the channel 382. The stuffer bar 324 engages the inner surface 384. The outer surface 386 engages the housing 302.

The post 370 includes a front 388 and a rear 389 opposite the front 388. The mating section 372 extends forward from the front 388. The open side of the retention section 380 is provided along the rear 389 of the post 370. The contact tail 378 extends rearward from the rear 389.

Returning to FIG. 5, the signal and ground contacts 336, 338 are received in the housing 302 through the rear 306. The signal and ground contacts 336, 338 are aligned with one another such that the contact tails 344, 378 are aligned with one another for mounting to the host circuit board 106 (shown in FIG. 1). Similarly, the retention sections 346, 380 are aligned with one another for receiving the stuffer bar 324. In an exemplary embodiment, the housing 302 includes an aperture 390 for receiving the retention sections 346, 380 and/or a portion of the stuffer bar 324. The aperture 390 includes a shelf 392 that faces upward. The retention sections 346, 380 rest on the shelf 392. Optionally, the stuffer bar 324 may hold the retention sections 346, 380 against the shelf 392. For example, the lower legs 352 may be pressed against the shelf 392 by the stuffer bar 324. The shelf 392 is positioned a predetermined distance 394 from the bottom 316 of the housing 302. As such, the contact tails 344, 378, which have a height 398 corresponding to the distance 394, are each aligned in proper position with respect to the housing 302. The contact tails 344, 378 are held coplanar with one another for mounting to the host circuit board 106.

Figure 8:
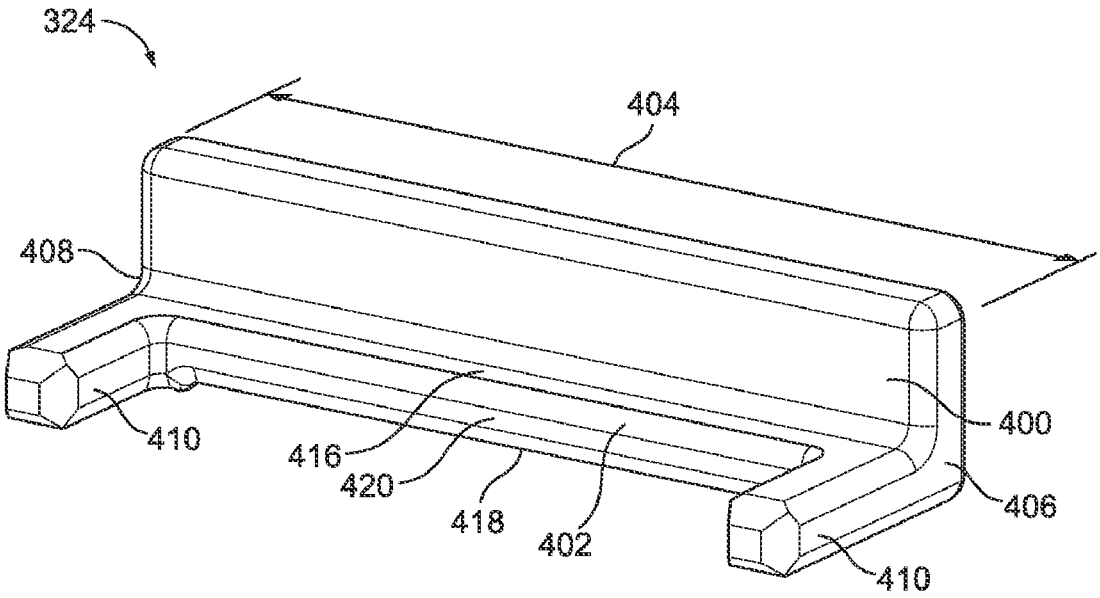
FIG. 8 illustrates a stuffer bar for the receptacle connector shown in FIG. 4.

FIG. 8 illustrates the stuffer bar 324 for the receptacle connector 120 (shown in FIG. 4). The stuffer bar 324 includes an elongated base 400 and a shoulder 402 that extends forward from the base 400. The base 400 has a width 404 measured between opposed sides 406, 408 that spans the rear 306 (shown in FIG. 4) of the housing 302 (shown in FIG. 4). Arms 410 are provided at corresponding sides 406, 408. The arms 410 may be received in the housing 302 to securely couple the stuffer bar 324 to the housing 302, such as by an interference fit. For example, the arms 410 may be received in apertures 412 (shown in FIG. 5) of the housing 302. Other types of retention features may be used in alternative embodiments to securely couple the stuffer bar 324 to the housing 302.

In an exemplary embodiment, the stuffer bar 324 is L-shaped with the shoulder 402 extending outward from a bottom of the base 400. The shoulder 402 is sized to fit within the retention sections 346, 380 (shown in FIG. 5) of the signal and ground contacts 336, 338 (shown in FIG. 5). Optionally, the shoulder 402 may fit snugly within the retention sections 346 such that the shoulder 402 engages the upper and lower legs 350, 352 (shown in FIG. 6) defining the retention sections 346. For example, the shoulder 402 may include an upper surface 416, an opposite lower surface 418, and forward facing surface 420 extending therebetween. The surfaces 416, 418 and 420 engage the legs 350-354, respectively. Alternatively, the shoulder 402 may fit in the retention sections 346, 380 such that only the lower surface 418 engages the lower leg 352 to hold the lower leg 352 against the shelf 392 (shown in FIG. 5).

Figure 9:
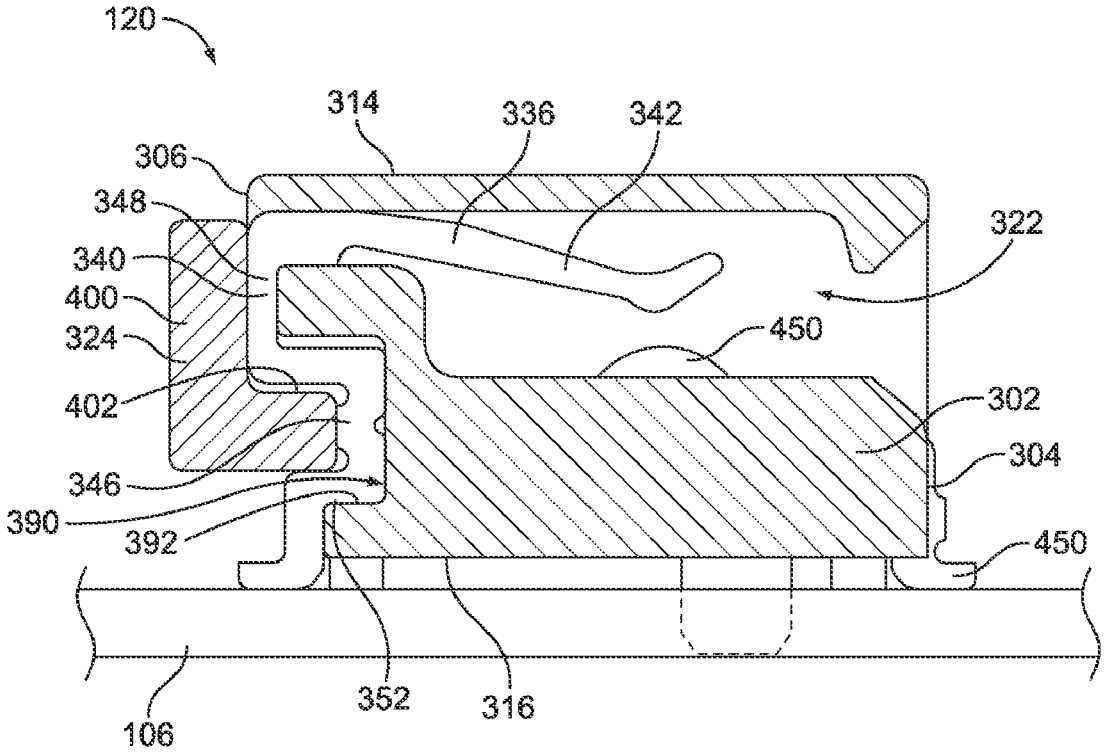
FIG. 9 is a cross sectional view of a portion of the receptacle connector shown in FIG. 4.

FIG. 9 is a cross sectional view of a portion of the receptacle connector 120 taken along one of the signal contacts 336. The receptacle connector 120 is illustrated mounted to the host circuit board 106. The signal contact 336 is received in the housing 302 and is configured for mating with the mating connector, such as the pluggable module 102 (shown in FIG. 1). The mating section 342 extends from the post 340 into the cavity 322 and is arranged for mating with a mating contact of the mating connector. In particular, the mating section 342 is arranged for mating with a mating contact in an upper row. The signal contact 336 may thus be referred to as an upper signal contact because the mating section 342 extends along an upper portion of the mating connector.

The mating connector may also include a lower row of contacts, in which case, lower contacts 450 may additionally be received within the housing 302 and electrically connected to the host circuit board 106. The lower contacts 450 are loaded into the housing 302 through the front 304 of the housing 302. In an alternative embodiment, the lower contacts 450 may be loaded into the housing 302 through the rear 306 in a similar manner as the signal contacts 336.

The signal contact 336 is held in the housing 302 by the stuffer bar 324. For example, during assembly, the signal contact 336 is loaded through the rear 306 of the housing 302 into the corresponding groove 330 (shown in FIG. 5). The retention section 346 is loaded into the aperture 390 and rests upon the shelf 392 of the housing 302. The shelf 392 vertically positions the signal contact 336 with respect to the top 314 and the bottom 316.

Once the signal contact 336 is loaded into the housing 302, the stuffer bar 324 is coupled to the housing 302. The stuffer bar 324 engages the signal contact 336 to hold the signal contact 336 within the housing 302. When assembled, the shoulder 402 is received within the retention section 346. In an exemplary embodiment, the aperture 390 has a height greater than a height of the retention section 346. As such, the retention section 346 is able to float within the aperture 390, which may allow easier assembly, such as by allowing the signal contacts 336 to be loaded into the aperture 390 without interference with the boundary walls of the aperture 390.

In an exemplary embodiment, to properly position the signal contact 336 with respect to the housing 302 for mounting to the host circuit board 106, the shoulder 402 of the stuffer bar 324 engages the retention portion 346 and forces the lower leg 352 against the shelf 392. The shoulder 402 may be chamfered or formed at a distal end thereof to locate the stuffer bar 324 within the retention sections 346 during assembly. For example, as the stuffer bar 324 is coupled to the housing 302, the shoulder 402 may engage the lower legs 352 and force the lower legs 352 downward against the shelf 392. As such, the shoulder 402 engages a horizontal portion of the signal contact 336 to resist movement of the signal contact 336 in a vertical direction away from the host circuit board 106.

Once the stuffer bar 324 is coupled to the housing 302, the upper portion of the base 400 is positioned behind the upper post section 348. In an exemplary embodiment, the base 400 extends along a majority of the upper post section 348 between the retention section 346 and the mating section 342. The base 400 holds the signal contact 336 within the cavity 322. For example, during mating with the mating connector, the signal contacts 336 may be pushed rearward. Without the base 400 positioned behind the upper post sections 348, the signal contacts 336 may tend to at least partially deflect rearward. However, with the base 400 positioned behind the upper post sections 348, the signal contacts 336 are rigidly held in the cavity 322. As such, the base 400 engages a vertical portion of the signal contact 336 to resist movement of the signal contact 336 in a horizontal direction away from the housing 302. For example, the stuffer bar 324 resists rearward movement of the signal contact 336.

The ground contacts 338 (shown in FIG. 7) are loaded into the housing 302 in a similar manner. The stuffer bar 324 interfaces with the ground contacts 338 in a similar manner, such as to hold the ground contacts 338 against the shelf 392 and/or to hold upper portions of the ground contacts 338 in the housing 302.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle connector comprising:

contacts having contact tails configured to be mounted to a circuit board, the contacts having retention sections positioned at a predetermined location relative to the contact tails, the contacts having mating sections configured for mating with a mating connector;

a housing holding the contacts, the housing having a front and a rear with a cavity at the front being configured to receive the mating connector, the housing having a shelf at the rear; and a stuffer bar separately provided from the housing and securely coupled to the rear of the housing, the stuffer bar being received within the retention sections of the contacts and engaging the contacts to hold the contacts against the shelf such that the contact tails are aligned with one another.

2. The receptacle connector of claim 1, wherein the contacts include a front and a rear, the retention sections having a lower leg and an upper leg defining a channel therebetween, the stuffer bar being received in the channel such that the stuffer bar holds the lower leg against the shelf.

3. The receptacle connector of claim 1, wherein the retention sections have lower legs and upper legs defining channels therebetween, the stuffer bar having a base and a shoulder extending forward from the base, the shoulder being received in the channels.

4. The receptacle connector of claim 1, wherein the contacts include a front and a rear, the stuffer bar having a base and a shoulder extending forward from the base, the shoulder being received in the retention sections, the base engaging the rear of the contacts to hold the contacts in the housing.

5. The receptacle connector of claim 1, wherein the contacts include posts extending between the retention sections and the mating sections, the mating sections extending generally perpendicular with respect to the posts, the stuffer bar engaging a majority of each post between the corresponding retention section and mating section.

6. The receptacle connector of claim 1, wherein the stuffer bar is L-shaped with a base and a shoulder extending from the base, the base engaging a vertical portion of the contacts to resist movement of the contacts in a horizontal direction away from the housing, the shoulder engaging a horizontal portion of the contacts to resist movement of the contacts in a vertical direction away from the circuit board.

7. The receptacle connector of claim 1, wherein the contacts constitute signal contacts and ground contacts, the ground contacts include barbs extending forward from the retention section engaging the housing by a friction fit to hold the ground contacts to the housing.

8. The receptacle connector of claim 1, wherein the contacts constitute signal contacts and ground contacts, the ground contacts each include an inner post and a retention barb at a front of the contacts, both the signal and ground contacts being stamped from a common stamp, wherein the retention barbs and the inner posts are removed during a stamping process to form the signal contacts, and wherein the retention barbs and the inner posts remain intact to define the ground contacts.

9. A transceiver assembly comprising:

a receptacle guide frame configured to be mounted to a host circuit board, the receptacle guide frame having a front being open to an interior space, the receptacle guide frame being configured to receive a pluggable module through the front; and a receptacle connector received within the interior space of the receptacle guide frame at a rear of the receptacle guide frame, the receptacle connector comprising:

contacts having contact tails configured to be mounted to a circuit board, the contacts having retention sections positioned at a predetermined location relative to the contact tails, the contacts having mating sections configured for mating with a mating connector;

a housing holding the contacts, the housing having a front and a rear with a cavity at the front being configured to receive the mating connector, the housing having a shelf at the rear; and a stuffer bar separately provided from the housing and securely coupled to the rear of the housing, the stuffer bar being received within the retention sections of the contacts and engaging the contacts to hold the contacts against the shelf such that the contact tails are aligned with one another.

10. The assembly of claim 9, wherein the contacts include a front and a rear, the retention sections having a lower leg and an upper leg defining a channel therebetween, the stuffer bar being received in the channel such that the stuffer bar holds the lower leg against the shelf.

11. The assembly of claim 9, wherein the retention sections have lower legs and upper legs defining channels therebetween, the stuffer bar having a base and a shoulder extending forward from the base, the shoulder being received in the channels.

12. The assembly of claim 9, wherein the contacts include a front and a rear, the stuffer bar having a base and a shoulder extending forward from the base, the shoulder being received in the retention sections, the base engaging the rear of the contacts to hold the contacts in the housing.

13. The assembly of claim 9, wherein the contacts include posts extending between the retention sections and the mating sections, the mating sections extending generally perpendicular with respect to the posts, the stuffer bar engaging a majority of each post between the corresponding retention section and mating section.

14. The assembly of claim 9, wherein the stuffer bar is L-shaped with a base and a shoulder extending from the base, the base engaging a vertical portion of the contacts to resist movement of the contacts in a horizontal direction away from the housing, the shoulder engaging a horizontal portion of the contacts to resist movement of the contacts in a vertical direction away from the circuit board.

15. The assembly of claim 9, wherein the contacts constitute signal contacts and ground contacts, the ground contacts include barbs extending forward from the retention section engaging the housing by a friction fit to hold the ground contacts to the housing.

16. The assembly of claim 9, wherein the contacts constitute signal contacts and ground contacts, the ground contacts each include an inner post and a retention barb at a front of the contacts, both the signal and ground contacts being stamped from a common stamp, wherein the retention barbs and the inner posts are removed during a stamping process to form the signal contacts, and wherein the retention barbs and the inner posts remain intact to define the ground contacts.

17. A receptacle connector for mating with a pluggable module of a transceiver assembly, the receptacle connector comprising:

contacts having posts and mating sections extending from the posts for mating with the pluggable module, the posts having a front and a rear with contact tails at an end thereof opposite the mating sections, the posts also having retention sections;

a housing holding the contacts, the housing having a front and a rear with a cavity at the front being configured to receive the pluggable module; and a stuffer bar separately provided from the housing and securely coupled to the housing proximate to the rear of the housing, the stuffer bar having a base and a shoulder extending forward from the base, the shoulder being received in the retention sections, the base engaging the rear of the posts to hold the contacts in the housing.

18. The receptacle connector of claim 17, wherein the retention sections have a lower leg and an upper leg defining a channel therebetween, the shoulder of the stuffer bar being received in the channel such that the shoulder engages the lower leg.

19. The receptacle connector of claim 17, wherein the base of the stuffer bar engages a majority of each post between the corresponding retention section and mating section.

20. The receptacle connector of claim 17, wherein the stuffer bar is L-shaped with the shoulder being perpendicular to the base, the base engaging a vertical portion of the posts to resist rearward movement of the contacts, the shoulder engaging a horizontal portion of the retention sections to resist movement of the contact tails in a vertical direction away from the circuit board.

* * * * *